US005628251A

United States Patent [19]

O'Bannion

[11] Patent Number: 5,628,251

[45] Date of Patent: May 13, 1997

[54] PRINTING PRESS BLANKET UNDERLINER

[76] Inventor: William N. O'Bannion, 2939 Oxfordshire, Dallas, Tex. 75234

[21] Appl. No.: 328,409

[22] Filed: Oct. 24, 1994

Related U.S. Application Data

[63] Continuation of Ser. No. 902,908, Jul. 23, 1992, abandoned.

[51] Int. Cl.[6] ..... F42B 27/08

[52] U.S. Cl. ..... 101/486; 101/492; 101/493; 101/DIG. 39

[58] Field of Search ..... 428/138, 709, 428/141, 304.4, 310.5, 409; 101/401, 493, DIG. 39, 251, 486, 492

[56] References Cited

U.S. PATENT DOCUMENTS

| | | | |
|---|---|---|---|
| 668,919 | 2/1901 | Hill et al. | 428/909 |
| 2,325,903 | 8/1943 | Blair et al. | 428/304.4 |
| 3,147,698 | 9/1964 | Ross | 428/909 |
| 3,676,282 | 7/1972 | Volmer | 428/909 |
| 3,887,750 | 6/1975 | Duckett et al. | 428/909 |
| 3,898,360 | 8/1975 | Neumann et al. | 428/310.5 |
| 4,422,895 | 12/1983 | Shimura et al. | 428/909 |
| 4,471,011 | 9/1984 | Spöring | 428/909 |
| 4,537,129 | 8/1985 | Heinemann et al. | 428/909 |
| 4,751,127 | 6/1988 | Pinkston et al. | 428/141 |
| 5,066,537 | 11/1991 | O'Rell et al. | 428/909 |
| 5,116,669 | 5/1992 | Sonobe | 428/909 |

*Primary Examiner*—Marion E. McCamish
*Assistant Examiner*—Blaine R. Copenheaver
*Attorney, Agent, or Firm*—Baker & Botts, L.L.P.

[57] ABSTRACT

A printing press blanket underliner is provided which allows for high quality printing on varying width items, such as envelopes, without the need for excess pressure on printing press blankets. The printing press blanket underliner is made of synthetic rubber of surgical quality and provides a resilient cushion underliner for printing press blankets.

2 Claims, 1 Drawing Sheet

PRINTING PRESS BLANKET UNDERLINER

CROSS-REFERENCE TO RELATED APPLICATIONS

This application is a continuation of application Ser. No. 07/902,908 filed Jul. 23, 1992, entitled "PRINTING PRESS BLANKET UNDERLINER" by William N. O'Bannion, now abandoned.

TECHNICAL FIELD OF THE INVENTION

This invention relates generally to printing presses, and more particularly to a printing press blanket underliner.

BACKGROUND OF THE INVENTION

With conventional printing presses, difficulties arise in printing items that have varying widths, such as envelopes. The varying widths of the items to be printed can result in poor quality and inconsistent printing across the items. A common practice for improving the quality of printing upon such items involves increasing the pressure on the printing blanket, to reduce the effects of the varying widths of the items to be printed. This technique, however, has a significant drawback in that the additional pressure on the printing blanket reduces the effective life of the printing blanket and also causes crushing of blankets.

Therefore, a need has arisen for a product which will allow quality printing of varying width items without exerting excess pressure on printing blankets.

SUMMARY OF THE INVENTION

In accordance with the teachings of the present invention, a printing press blanket underliner is disclosed which significantly reduces or eliminates problems and disadvantages associated with prior art printing systems.

In particular, a printing press blanket underliner is disclosed which comprises a layer of rubber, the layer being separate from the printing press blanket and operable to provide a resilient cushion for the printing press blanket. Furthermore, a printing press system is disclosed which includes a printing press blanket and a printing press blanket underliner comprising a layer of rubber.

An important technical advantage of the present invention is the fact that high-quality and consistent printing may be completed on items having varying widths, such as envelopes, without exerting excess pressure on printing press blankets.

BRIEF DESCRIPTION OF THE DRAWINGS

For a more complete understanding of the present invention and the advantages thereof, reference is now made to the following description taken in conjunction with the accompanying drawing which illustrates a printing press blanket underliner constructed according to the teachings of the present invention.

DETAILED DESCRIPTION OF THE INVENTION

Figure 1:
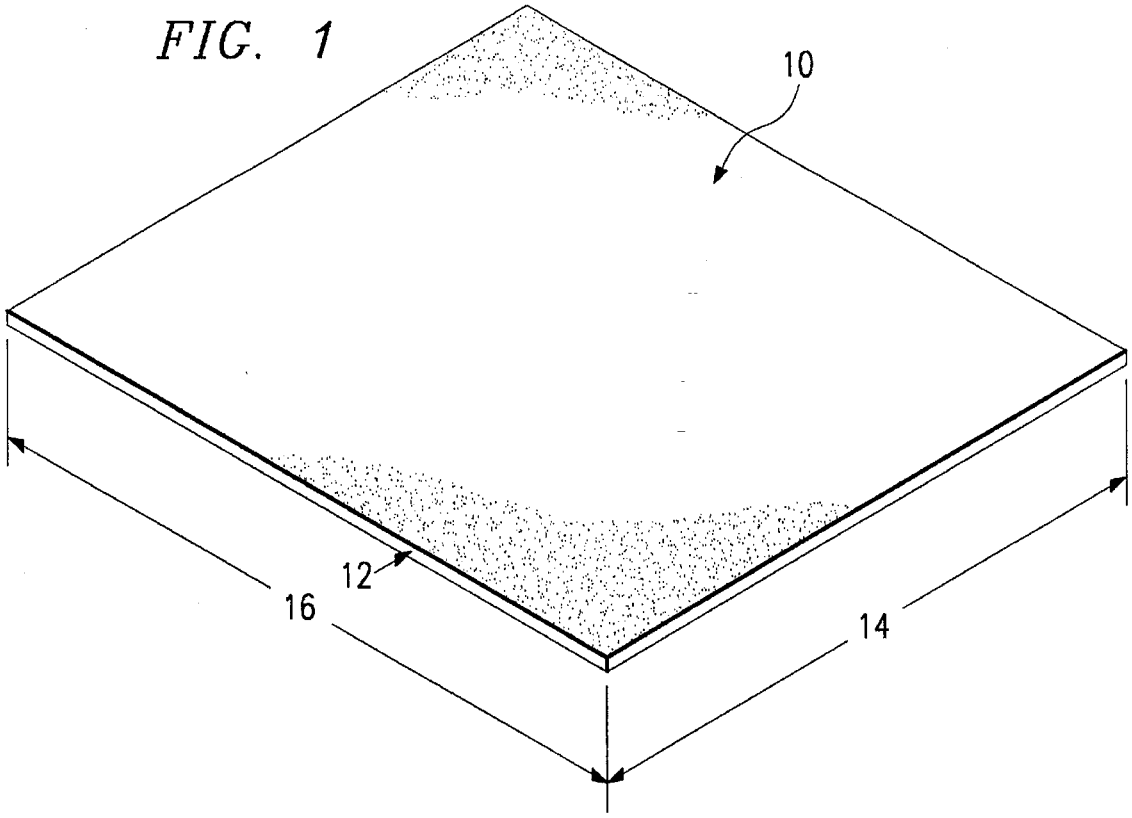

The following disclosure document is hereby set forth to describe an inventive idea developed solely by William Neal O'Bannion and will be referred to as the invention or the product. The product is illustrated and referred to by reference numeral 10 in FIG. 1.

The invention, which may be made of a synthetic surgical quality rubber, when produced in a dimensional thickness of 8 to 10 thousandths of an inch has the unique quality of compressibility, yet will return to the original production dimensional thickness in less than one tenth of a second. The thickness is referred to by reference numeral 12 in FIG. 1. The width and length of the sheet of the product is governed by whether the product is to be used in the part-time installation or in the permanent fulltime installation. The width and length are referred to by reference numerals 14 and 16 respectively in FIG. 1.

In the part-time installation of the product, it is simply installed under the normal blanket of any offset press for the purpose of printing ready made envelopes without the necessary make ready and down time required. The only adjustment to the printing equipment is the release of the pressure control which allows the product to prevent damage to the blanket..

In the permanent full-time installation, the purpose of the product is to improve the quality of images by removing gear marks and rough features found in certain stocks. Further, when the printing equipment is properly adjusted to the invention it allows the conversion to envelope production without ever removing the product or resetting the press equipment.

The invention has a synthetic "water bed effect" as it allows the blanket to move up and down in micro adjustments which prevents the press blanket from being crushed, a very common problem in the printing industry.

Tests have shown that the invention should only be made in the thickness of 8 to 10 thousandths of an inch. If it is made less than 8 thousandths of an inch, then damage will occur to the blanket. More than 10 thousandths of an inch will cause distorted images.

The width and length of the invention is governed by the type and size of presses used. This means that any size from 5 inches to 48 inches are possible in both length and width of the product.

The invention is designed to take the impact of an envelope going through a printing press without crushing the blankets on the press. This lets you use the same blanket for both envelope and flat sheet printing without causing damage to the blanket.

The invention eliminates shadows and trails in envelopes without the use of a make ready. This is possible because the product gives under the pressure of the envelope rather than the blanket having to give under the pressure.

The invention installs easily under the blanket and there are no special skills needed.

There is no make ready required as in other forms of envelope production.

The invention eliminates sticky back blankets, which are the most popular form of blanket for envelope production, thus decreasing blanket cost.

The invention eliminates a lot of down time as it can be installed quickly—and in cases where full sheets are used under the blanket for full time operations, there is no down time at all.

The invention, when used in the full time operation, also eliminates gear marks and makes full coverage easier on rough textured stocks.

In five years of testing where the product was properly used, it showed an average 52% blanket cost savings.

By using the invention, most shops will also save on other shop supplies usually needed for blanket repair.

Printing shops can also do difficult envelope jobs on ready made envelopes that they use to run as flat sheet and have converted. The product works so well that even experts can not tell that the job was run on a ready made envelope. Therefore the print shop can put profits into his pocket by not having to pay for conversion cost.

The invention has shown in tests to last up to 90 days, even longer when the equipment is in good working condition.

The invention also reduces wear on bearings because of the reduced pressure needed with the product.

The invention lets the print shop put a less skilled person on envelope runs without fear of rerunning the job.

What is claimed is:

1. A method of printing on stock with a printing press, comprising:

placing a cushioning underliner on a blanket cylinder, the underliner comprising a layer of surgical quality rubber having a thickness substantially in the range of 0.008 inches to 0.010 inches;

placing a printing press blanket over the underliner, the printing press blanket being separate from the underliner and operable to provide a resilient cushion for said printing press blanket during printing;

loading a stock into the printing press; and printing on the stock.

2. The method of claim 1, wherein the steps of loading and printing stock comprise the steps of:

loading a rough textured stock into the printing press; and printing on the rough textured stock.

* * * * *